US008833916B2

(12) United States Patent
Hara et al.

(10) Patent No.: US 8,833,916 B2
(45) Date of Patent: Sep. 16, 2014

(54) LIQUID EJECTING HEAD AND LIQUID EJECTING APPARATUS

(75) Inventors: Keiji Hara, Minowa (JP); Hajime Nakao, Azumino (JP)

(73) Assignee: Seiko Epson Corporation (JP)

( * ) Notice: Subject to any disclaimer, the term of this patent is extended or adjusted under 35 U.S.C. 154(b) by 238 days.

(21) Appl. No.: 13/427,266

(22) Filed: Mar. 22, 2012

(65) Prior Publication Data

US 2012/0241368 A1 Sep. 27, 2012

(30) Foreign Application Priority Data

Mar. 24, 2011 (JP) ..... 2011-066809

(51) Int. Cl.
*B41J 2/17* (2006.01)
*B41J 2/19* (2006.01)
*B41J 2/175* (2006.01)

(52) U.S. Cl.
CPC ..... *B41J 2/17563* (2013.01)
USPC ..... 347/93; 347/84; 347/92

(58) Field of Classification Search
USPC ..... 347/84, 92, 93
See application file for complete search history.

(56) References Cited

U.S. PATENT DOCUMENTS

| | | | | |
|---|---|---|---|---|
| 7,878,638 | B2 | 2/2011 | Akase et al. | |
| 2001/0030676 | A1* | 10/2001 | Owaki et al. | 347/93 |
| 2011/0242239 | A1* | 10/2011 | Hara | 347/93 |

FOREIGN PATENT DOCUMENTS

| | | |
|---|---|---|
| JP | 2007-260948 | 10/2007 |
| JP | 2008-068463 | 3/2008 |
| JP | 2009-208368 | 9/2009 |

* cited by examiner

*Primary Examiner* — Benjamin Kurtz
(74) *Attorney, Agent, or Firm* — Harness, Dickey & Pierce, P.L.C.

(57) ABSTRACT

An liquid ejecting apparatus includes a head main body which ejects liquid and a flow channel member to which the head main body is fixed, the flow channel member includes a plurality of liquid chambers to which the liquid is supplied, and a filter chamber which communicates with each liquid chamber and in which a filter is provided, the liquid passing through the liquid chamber and the filter chamber is supplied to the head main body, inlets which are opened to the liquid chamber and communicate with each filter chamber, the filter chamber includes a plurality of first filter chambers which are juxtaposed in a first row and a plurality of second filter chambers which are juxtaposed in a second row, the first filter chambers directly communicate with the inlet, and the second filter chambers communicate with the inlet through the communicating flow channel.

14 Claims, 7 Drawing Sheets

LIQUID EJECTING HEAD AND LIQUID EJECTING APPARATUS

BACKGROUND

1. Technical Field

The present invention relates to a liquid ejecting head and a liquid ejecting apparatus which eject liquid, and particularly, to an ink jet type recording head and an ink jet type recording apparatus which discharge ink as the liquid.

2. Related Art

In an ink jet type recording head which is an example of a liquid ejecting head, a pressure change is generated in a pressure generation chamber which communicates with a nozzle opening, and ink droplets are discharged from the nozzle opening.

Here, an ink jet type recording head is suggested in which a valve unit which is a flow channel member is provided (for example, refer to JP-A-2007-260948).

In the valve unit, a flow channel member main body is held and configured in an inner portion of a cover. In addition, a flow channel is provided in the flow channel member main body, and a pressure adjusting chamber which is a liquid chamber and a valve which is opened and closed according to the pressure change of the pressure adjusting chamber are provided in the middle of the flow channel.

In the flow channel member, since the pressure adjusting chamber is one for adjusting the pressure which operates the valve, the pressure adjusting chamber needs a uniform volume and positions of the inlets to downstream flow channels are required to be provided in the same positions. In addition, the opening position of the flow channel which is connected to a head main body is regulated by a sequence of the head main body. In addition, a filter chamber in which a filter is disposed is provided between the pressure adjusting chamber and the head main body. In the filter chamber, there is a demand that a flow channel resistance be decreased by obtaining a wide filter area as possible and lots of bubbles are trapped by extending the volume of the filter chamber, in which the filter is disposed, at the maximum. However, if the filter area is widened and the volume of the filter chamber is increased, there is a problem in that the size of the flow channel member is increased and the size of the ink jet type recording head is increased.

Moreover, conversely, if the size of the flow channel member is decreased, the filter area is decreased and the volume of the filter chamber is decreased, the flow channel resistance of ink which passes through the filter is increased, a supply failure is generated, and the amount of the bubbles trapped by the filter is decreased. Therefore, frequent cleaning operations are required, and there is a problem in that disadvantages such as increase of wasteful ink consumption are generated.

Moreover, the above-described problems are similarly generated in not only the ink jet type recording head but also a liquid ejecting head which ejects a liquid other than ink.

SUMMARY

An advantage of some aspects of the invention is to provide a liquid ejecting head and a liquid ejecting apparatus in which the area of a filter and volume of a filter chamber are secured at the maximum and the size can be decreased.

According to an aspect of the invention, there is provided a liquid ejecting head including a head main body which ejects liquid and a flow channel member to which the head main body is fixed, wherein the flow channel member includes a plurality of liquid chambers to which the liquid is supplied, and a filter chamber which communicates with each liquid chamber and in which a filter is provided, the liquid passing through the liquid chamber and the filter chamber is supplied to the head main body, inlets which are opened to the liquid chamber and communicate with each filter chamber are provided so as to be arranged in one row, the filter chamber includes a plurality of first filter chambers which are juxtaposed in a first row and a plurality of second filter chambers which are juxtaposed in a second row, the inlets are directly opened to the first filter chambers, and a communicating flow channel which communicates with the inlet of the liquid chamber corresponding to the second filter chamber is provided between the first filter chamber and the first filter chamber adjacent to the first filter chamber.

In the aspect, since the first filter chambers and the second filter chambers are provided in two rows, even in a state where the position of the inlets or the like is regulated, volume of the filter chamber is secured at the maximum, and area of the filter can be secured at the maximum in a state where the size of the flow channel member is decreased.

In the liquid ejecting head of the aspect of the invention, volume of the first filter chambers may be the same as the volume of second filter chambers. According to this, the same amount of bubbles can be held in the filter chamber, and a cleaning operation can be performed at the same timing. In addition, variation in the supply characteristics supply characteristic of the liquid can be suppressed.

In the liquid ejecting head of the aspect of the invention, a first flow channel member in which the liquid chambers and the inlets are formed, a second flow channel member in which the first filter chambers, the second filter chambers, and the communicating flow channel are formed, and a third flow channel member which partitions one surface side of the filter chamber and in which the filter is held may be laminated to one another. According to this, since the first flow channel member, the second flow channel member, and the third channel member are laminated to one another, each member can be easily manufactured by an inexpensive manufacturing method such as molding.

In the liquid ejecting head of the aspect of the invention, the number of the second filter chambers may be smaller by one or more than the number of the first filter chambers. According to this, increase in the size of the flow channel member is suppressed, and it is possible to dispose the filter chambers in the largest volume with the greatest numbers.

According to another aspect of the invention, there is provided a liquid ejecting apparatus including the liquid ejecting head described above.

In another aspect, decrease in the size of the liquid ejecting apparatus can be realized.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention will be described in detail with reference to embodiments.

First Embodiment

Figure 1:
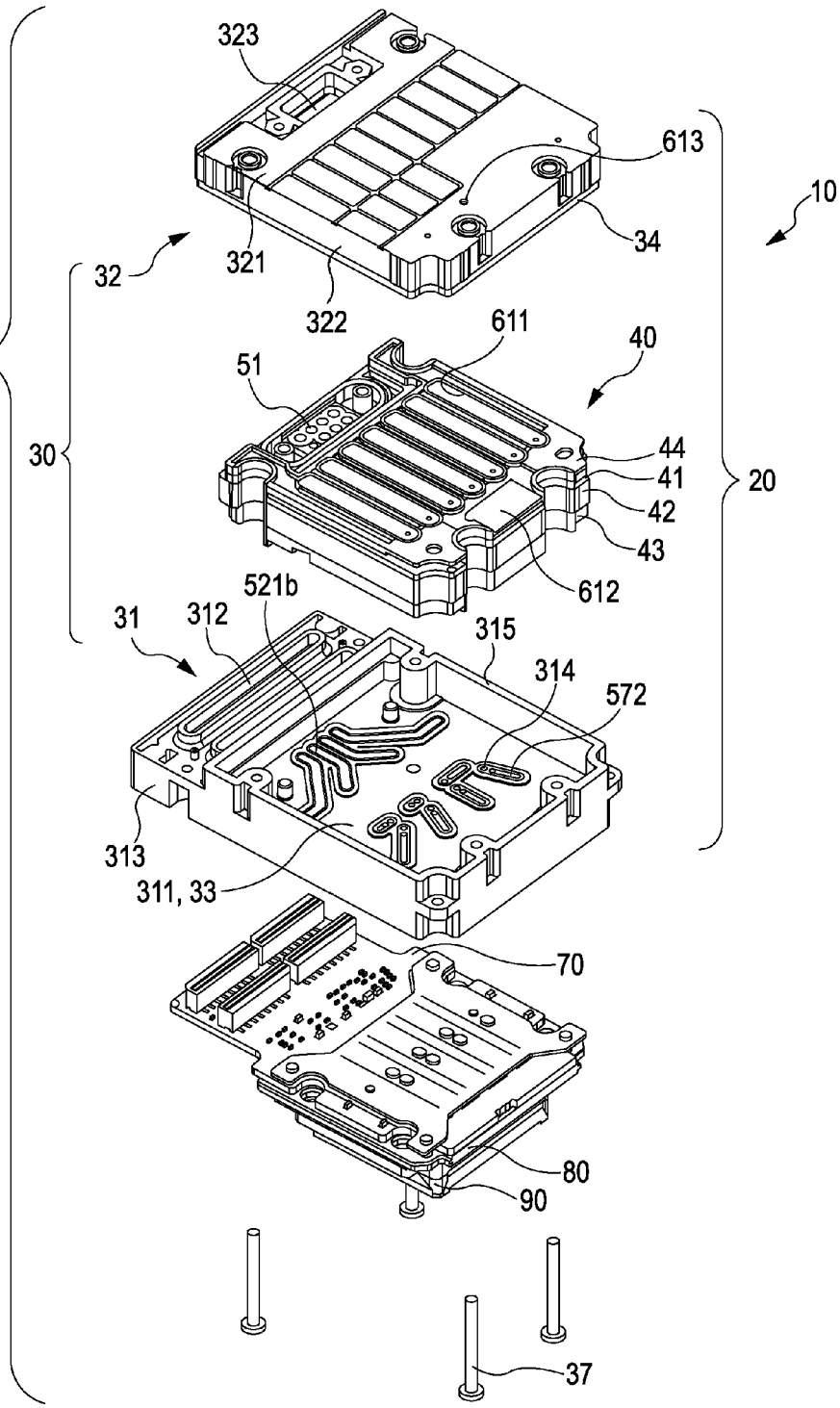
FIG. 1 is an exploded perspective view of a recording head according to a first embodiment of the invention.
Figure 2:
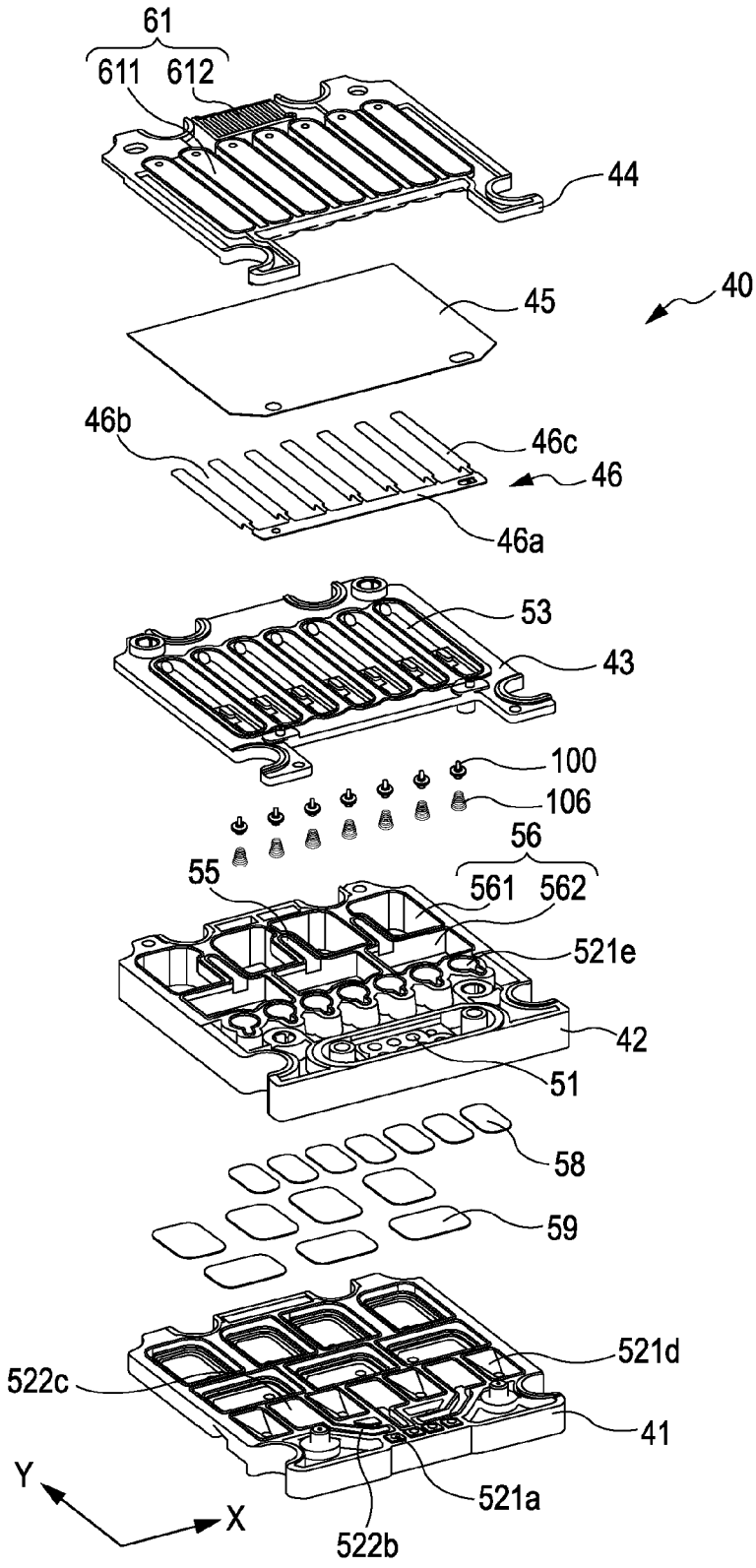
FIG. 2 is an exploded perspective view of a flow channel member main body according to the first embodiment of the invention.
Figure 3:
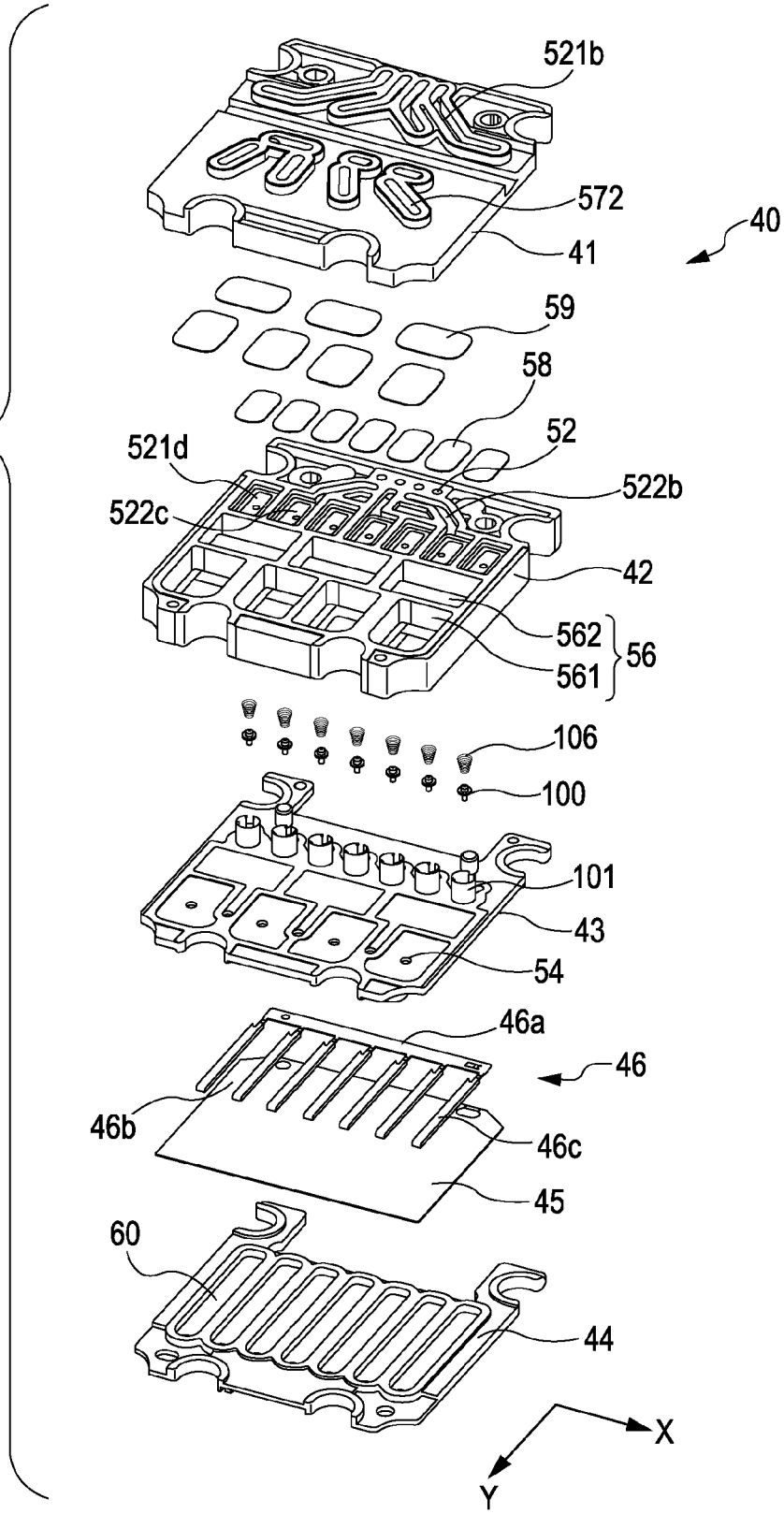
FIG. 3 is an exploded perspective view of the flow channel member main body according to the first embodiment of the invention.
Figure 4:
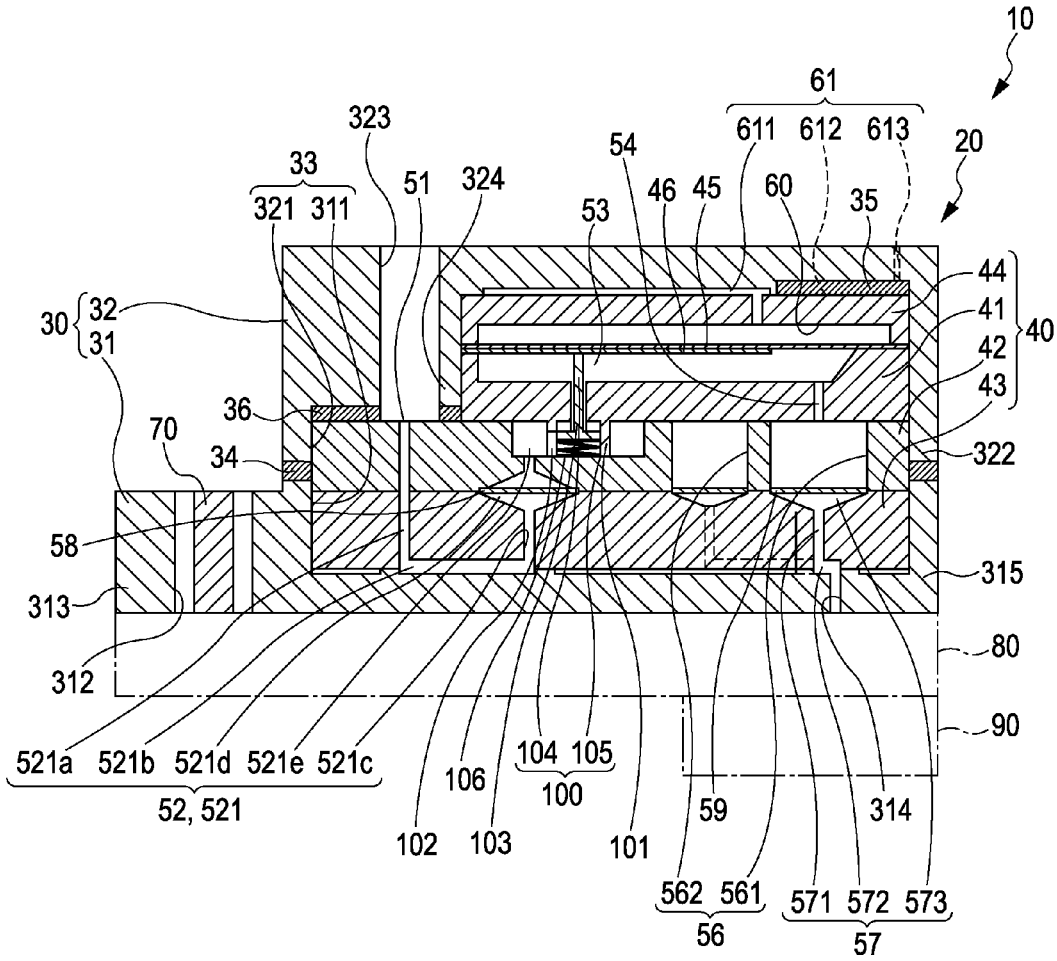
FIG. 4 is a cross-sectional view of a main portion of the recording head according to the first embodiment of the invention.
Figure 5:
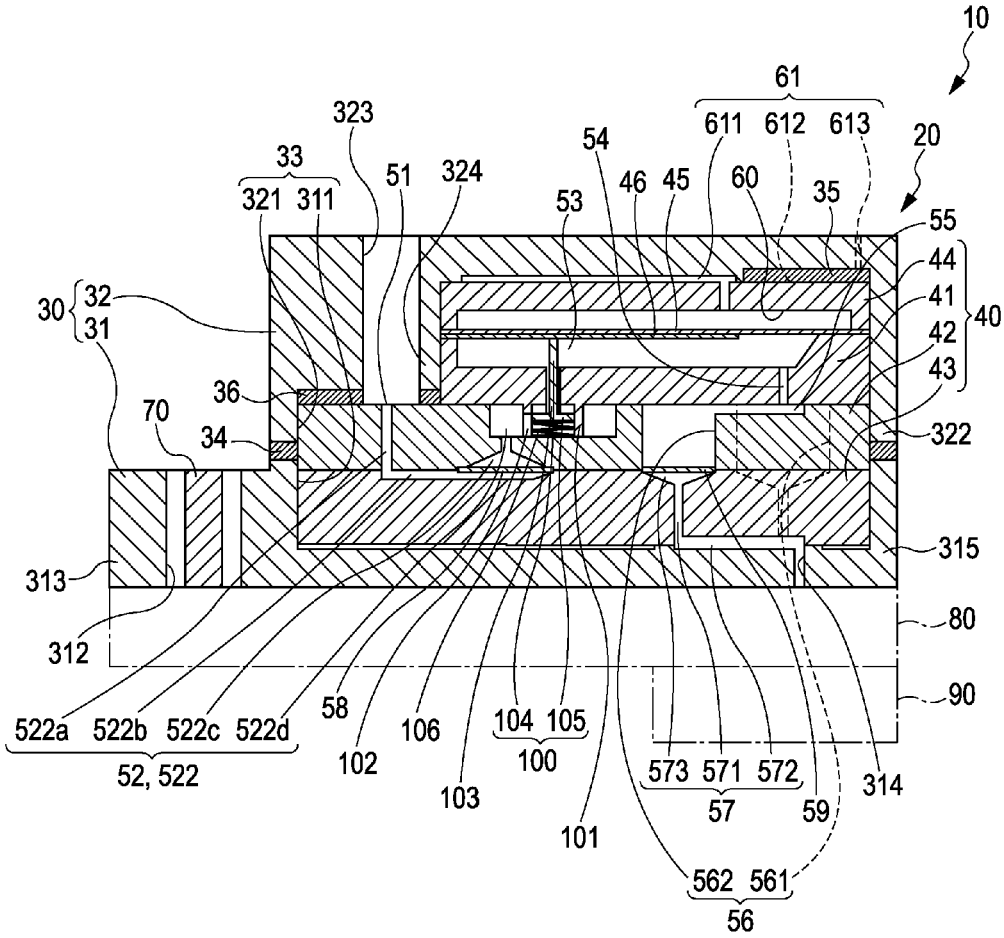
FIG. 5 is a cross-sectional view of a main portion of the recording head according to the first embodiment of the invention.
Figure 6:
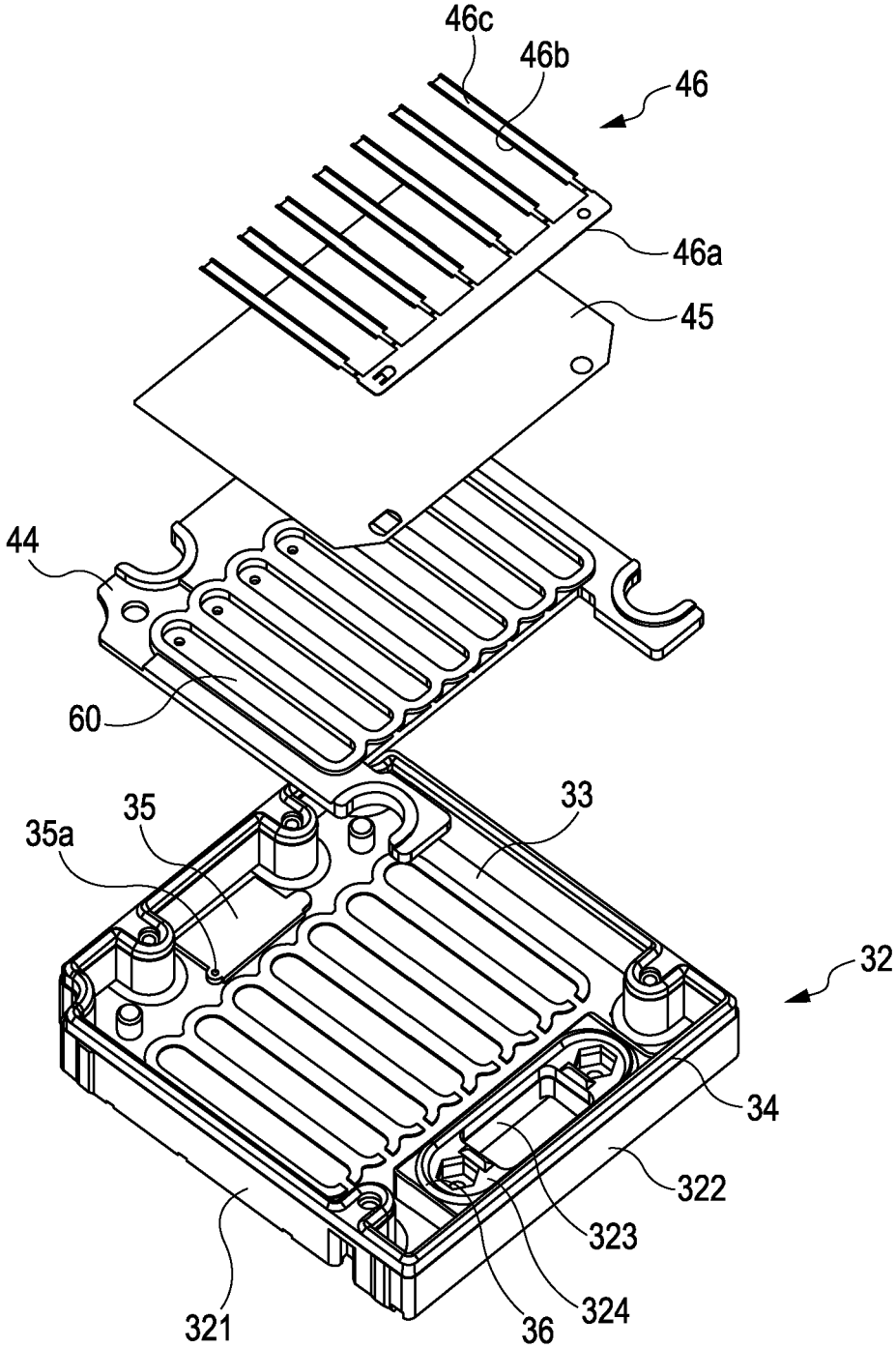
FIG. 6 is an exploded perspective view of a main portion of a back pressure control unit according to the first embodiment of the invention.

FIG. 1 is an exploded perspective view of an ink jet type recording head which is an example of a liquid ejecting head according to a first embodiment of the invention, FIG. 2 is an exploded perspective view from a first flow channel member side of a flow channel member main body, FIG. 3 is an exploded perspective view from a third flow channel member side of the flow channel member main body, FIGS. 4 and 5 are cross-sectional views of a main portion of the recording head, and FIG. 6 is an exploded perspective view of a main portion of aback pressure control unit.

As shown in FIG. 1, an ink jet type recording head 10 which is an example of a liquid ejecting head according to the first embodiment of the invention includes a back pressure control unit 20 which is a flow channel member, a circuit board 70 which is provided on a bottom surface of the back pressure control unit 20, a head case 80 which is provided on a side opposite to the back pressure control unit 20 of the circuit board 70, and a head main body 90 which is fixed to the head case 80.

The back pressure control unit 20 is a flow channel member which supplies ink from liquid storage means, such as an ink tank in which the outside ink is stored, to the head main body 90.

Here, the back pressure control unit 20 will be described in detail. The back pressure control unit 20 includes a cover 30 which is constituted of a hollow box-shaped member and a flow channel member main body 40 which is provided in the inner portion of the cover 30.

The cover 30 includes a base portion 31 and a cover portion 32 which are vertically divided. The base portion 31 includes a first holding portion 311 which is opened to the cover portion 32 side and has a concave shape, and a supporting portion 313 which is provided in an end side of the first holding portion 311 and in which a wiring insertion hole 312 penetrating in a thickness direction is provided.

In addition, a plurality of supply ports 314, which are penetrated in the thickness direction and supply the ink to the head main body, are provided in the bottom surface of the first holding portion 311 of the base portion 31. In the embodiment, seven supply ports 314 are provided on the bottom surface of the base portion 31.

As shown in FIGS. 1 and 6, the cover portion 32 has a size which covers the first holding portion 311 of the base portion 31, and includes a second holding portion 321 which faces the first holding portion 311 of the base portion 31 and has a concave shape opened to the base portion 31 side.

In addition, as shown in FIGS. 4 and 5, due to the fact that the first holding portion 311 and the second holding portion 321 of the base portion 31 and the cover portion 32 are opposed and fixed to each other, a holding portion 33 which is a space partitioned by the first holding portion 311 and the second holding portion 321 is formed in the inner portion of the cover portion 32.

Here, as shown in FIGS. 4 to 6, a first wall portion 315 which partitions a side surface of the first holding portion 311 is provided in the base portion 31. Moreover, a second wall portion 322 which partitions a side surface of the second holding portion 321 is provided in the cover portion 32. In addition, in the base portion 31 and the cover portion 32, the tip surface of the first wall portion 315 and the tip surface of the second wall portion 322 are abutted and fixed to each other via a first seal portion 34. That is, the first seal portion 34 which is formed of rubber, elastomer, or the like is interposed between the first wall portion 315 and the second wall portion 322. Of course, the first seal portion 34 may be bonded by using heat welding or adhesives. In addition, as shown in FIG. 1, the base portion 31 and the cover portion 32 are fixed to each other due to the fact that a fastening member 37 such as screw is inserted from the base portion 31 side and the fasting member 37 are screwed to the cover portion 32.

Moreover, an opening portion 323 which communicates with the bottom surface of the second holding portion 321 and penetrates in the thickness direction is provided in the cover portion 32. The opening portion 323 is opened to an outer circumferential surface of the cover portion 32, is provided in the bottom surface of the second holding portion 321, and is provided so as to be opened to a protrusion 324 which is protruded lower than the second wall portion 322 partitioning the side surface of the second holding portion 321.

In the flow channel member main body 40 which is held to the holding portion 33 of the cover 30, as shown in FIGS. 2 to 5, in the present embodiment, a first flow channel member 41 which is provided on the cover 30 side, a second flow channel member 42 which is provided on the base portion 31 side of the first flow channel member 41, and a third flow channel 43 which is provided on the base portion 31 side of the second flow channel portion 42 are constituted so as to be overlapped with one another. A protection plate 44 is provided on the cover portion 32 side of the first flow channel member 41 in the flow channel member main body 40.

Each of the first flow channel member 41, the second flow channel member 42, the third flow channel member 43, and the protection plate 44 is formed of a plate-like member which is formed of resin materials, metal materials, or the like. Moreover, the first flow channel member 41, the second flow channel member 42, the third flow channel member 43, and the protection plate 44 are held in the holding portion 33 of the cover 30 in the state of being laminated to one another.

A liquid flow channel which supplies ink from an ink storage means, in which the ink in the outside is stored, to the head main body 90 is provided in the flow channel member main body 40 which is constituted of the first flow channel member 41, the second flow channel member 42, and the third channel member 43.

Specifically, as shown in FIGS. 4 and 5, the liquid flow channel includes an introduction path 52 having a connection port 51 to which other end of a supply tube (not shown), which is a tubular member of a tube or the like in which the one end side is connected to the ink storage means, is connected, a pressure adjusting chamber 53 which is a liquid chamber to which the ink from the introduction path 52 is supplied, an inlet 54 which communicates with the pressure adjusting chamber 53, a filter chamber 56 which directly communicates the inlet 54 or communicates via a communicating flow channel 55, and a supply path 57 which supplies the ink from the filter chamber 56 to the head main body 90.

Here, the connection port 51 is provided so as to be opened to the inner portion of the opening portion 323 of the cover portion 32 on the upper surface of the second flow channel member 42. A plurality of connection ports 51 are provided corresponding to a plurality of inks. In the embodiment, seven connection ports 51 are provided (refer to FIGS. 1 and 2).

The introduction path 52 which has the connection port 51 includes a flow channel which penetrates the second flow channel member 42 or the first flow channel member 41, a flow channel between the second flow channel member 42 and the first flow channel member 41, a flow channel between the first flow channel 41 and the base portion 31, or the like.

Specifically, the introduction path 52 of the embodiment includes two paths such as a first introduction path 521 shown in FIG. 4 and a second introduction path 522 shown in FIG. 5.

As shown in FIG. 4, the first introduction path 521 includes a first introducing flow channel 521*a* which penetrates the second flow channel member 42 and the third flow channel member 43 in the thickness direction, a second introducing flow channel 521*b* which is formed in a concave shape in the bottom surface of the third flow channel 43 and in which the end communicates with the first introducing flow channel 521*a*, a third introducing flow channel 521*c* which communicates with the other end side of the second introducing flow channel 521*b* and is provided so as to penetrate the third flow channel member 43, a filter chamber for introducing 521*d* which is provided between the third flow channel 43 and the second flow channel member 42 and communicates the third introducing flow channel 521*c*, and a fourth flow channel 521*e* which communicates the filter chamber for introducing 521*d* and is provided so as to penetrate the second flow channel member 42.

As shown in FIG. 5, the second introduction path 522 includes a fifth introducing flow channel 522*a* which communicates with the connection port 51 and penetrates the second flow channel member 42 in the thickness direction, a sixth introducing flow channel 522*b* which is provided between the second flow channel member 42 and the third flow channel 43 and has a concave shape, a filter chamber for introducing 522*c* which communicates with the sixth introducing flow channel 522*b*, and a seventh introducing flow channel 522*d* which is communicates with the filter chamber for introducing 522*c* and is provided so as to penetrate the second flow channel member 42 in the thickness direction.

That is, the first introduction path 521 passes through the second introducing flow channel 521*b* between the third flow channel member 43 and the base portion 31 and reaches the pressure adjusting chamber 53. On the other hand, the second introduction path 522 does not pass through between the third flow channel member 43 and the base portion 31, and passes through the sixth introducing flow channel 522*b* between the second flow channel member 42 and the third flow channel member 43 and reaches the pressure adjusting chamber 53.

Moreover, a filter for introducing 58 which removes foreign matter such as dust or air bubbles included in the ink is provided in the filter chambers for introducing 521*d* and 522*c* which is provided in the middle of each of the first introduction path 521 and the second introduction path 522.

Here, in the filter chamber for introducing 521*d* in the middle of the first introduction path 521, the filter for introducing 58 of the filter chamber for introducing 521*d* is interposed between the third introducing flow channel 521*c* and the fourth introducing flow channel 521*e* and communicates with each of the channels. Therefore, the ink which is supplied from the third introducing flow channel 521*c* passes through the filter for introducing 58 and supplied to the fourth introducing flow channel 521*e*.

Similarly, in the filter chamber for introducing 522*c* provided in the middle of the second introduction path 522, the filter for introducing 58 is interposed between the sixth introducing flow channel 522*b* and the seventh introducing flow channel 522*d* and communicates with each of the channels. Therefore, the ink which is supplied from the sixth introducing flow channel 522*b* passes through the filter for introducing 58 and supplied to the seventh introducing flow channel 522*d*.

In addition, in the embodiment, as shown in FIGS. 2 and 3, seven connection ports 51 are provided, and seven introduction paths 52 are provided corresponding to the seven connection ports 51. Moreover, in the seven introduction paths 52, four first introduction paths 521 are provided, and three second introduction paths 522 are provided.

In this way, due to the fact that two kinds of the introduction paths 52 such as the first introduction path 521 which is constituted of the first introducing flow channel 521*a* to the fourth introducing flow channel 521*e* and the second introduction path 522 which is constituted of the fifth introducing flow channel 522*a* to the seventh introducing flow channel 522*d* are provided, the second introducing flow channel 521*b* and the sixth introducing flow channel 522, which are used in the connection from the introduction path 52 in which the ink flows downward in the drawing to the introduction path 52 in which the ink flows upward in the drawing in the FIGS. 4 and 5, can be disposed in different positions such as between the third flow channel member 43 and the base portion 31 and between second flow channel member 42 and the third flow channel member 43. Thereby, an area in which the second introducing flow channel 521*b* and the sixth introducing flow channel 522*b* are provided can be decreased, the size of the flow channel member main body 40 is decreased, and the size of the back pressure control unit 20 can be decreased. Moreover, each introduction path 52 communicates with each pressure adjusting chamber 53 which is provided in the first flow channel member 41.

The pressure adjusting chamber 53 has a concave shape which is opened to the side opposite to the second flow channel member 42 of the first flow channel member 41 which is a plate-like member. In addition, the pressure adjusting chamber 53 communicates with the introduction path 52 at the bottom surface of the one end side in the direction perpendicular to the juxtaposed direction, and communicates with the filter chamber 56 via the inlet 54 which is provided in the bottom surface of the other end side.

The pressure adjusting chamber 53 is sealed by a film member 45 which is provided on the opening surface of the first flow channel member 41. Here, the film member 45 is a thin film having flexibility and is fixed to the surface of the first flow channel member 41 by heating welding or the like. Moreover, the film member 45 is press-molded so as to be a state of being bent in a dome shape in the pressure adjusting chamber 53.

In addition, an elastic plate 46 which is disposed on the film member 45 side is provided in the pressure adjusting chamber 53 of the first flow channel member 41. The elastic plate 46 is provided so as to be protruded into the pressure adjusting chamber 53 in a state where the one end side of the elastic plate is fixed to the front surface side of the first flow channel member 41, and the tip of the elastic plate becomes a free end in the pressure adjusting chamber 53. In the embodiment, as shown in FIGS. 2 and 3, the elastic plate 46 includes a common portion 46*a* in which a plurality of elastic plates 46 are common in the fixed end side and an elastic portion 46*c* which is divided by slits 46*b* protruded into the pressure adjusting chamber 53. Therefore, the elastic plate 46 is formed so as to include a so-called comb-like shape.

Due to the fact that the common portion 46*a* is held to the opening surface side of the pressure adjusting chamber 53, the elastic plate 46 is fixed. In addition, as the elastic plate 46, a plate-like member having elasticity and ink resistance may be used, and in the embodiment, a stainless steel plate is used as the elastic plate.

As shown in FIGS. 4 and 5, the filter chamber 56 is provided so as to penetrate the second flow channel member 42 in the thickness direction. Here, the filter chamber 56 includes a plurality of first filter chambers 561 which are juxtaposed in a first row and a plurality of second filter chambers 562 which are juxtaposed in a second row.

That is, as shown in FIGS. 2 and 3, the first filter chambers 561 are juxtaposed in a first direction X which is the juxtaposed direction of the pressure adjusting chambers 53 and constitutes the first row.

Similarly, the second filter chambers 562 are juxtaposed in the first direction X which is the juxtaposed direction of the pressure adjusting chambers 53 and constitutes the second row. In addition, the first row of the first filter chambers 561 and the second row of the second filter chambers 562 are provided in a line in a second direction Y which is a direction perpendicular to the first direction X.

In the embodiment, four first filter chambers 561 are provided in the region which faces the inlet 54, and three second filter chambers 562 are provided in the introduction path 52 side in the second direction Y rather than the inlet 54.

Moreover, the first filter chambers 561 and the second filter chambers 562 are formed so that the opening of the first flow channel member 41 side is a rectangular shape. In addition, the first chambers 561 are juxtaposed so that the plane direction of the shorter side of the opening is the first direction X. On the other hand, the second filter chambers 562 are disposed so as to be rotated about 90° with respect to the first filter chambers 561. That is, the second filter chambers are juxtaposed so that the plane direction of the longer side of the opening is the first direction X.

In addition, as shown in FIGS. 2 and 5, a communicating flow channel 55 which is opened to the first flow channel member 41 side is provided between the adjacent first filter chambers 561 in the first direction X of the second flow channel member 42. The communicating flow channel 55 has a concave shape which is opened to the surface of the first flow channel member 41 side of the second flow channel member 42, and the one end of the flow channel 55 is provided in the region facing the inlet 54 and communicates with the inlet 54, and the other end communicates with the second filter chamber 562.

Here, the inlets 54 are provided so as to be arranged in one row in the juxtaposed direction (first direction X) of the pressure adjusting chambers 53. The inlets 54 are arranged in one row according to the following reasons. That is, if the inlets 54 are provided in different positions, variation is generated in a control pressure which is operated by valves 100 described hereinafter, an ink supply characteristic is varied, and discharging characteristic of the ink droplet which is discharged from the head main body 90 is varied.

The inlets 54 which are arranged in one row in this way alternately communicate the first filter chamber 561 and the second filter chamber 562. Specifically, the inlets 54 are directly opened to the first filter chamber 561 alternately. In addition, the inlets 54 which do not communicate with the first filter chambers 561 face the partition between the adjacent first chambers 561 in the first direction X, and communicate with the second filter chambers 562 via the communicating flow channels 55 which are provided in the partition. In the embodiment, as described above, four first chambers 561 are provided, three second filter chambers 562 are provided, and three communicating flow channels 55 are provided between four first filter chambers 561. In this way, since the communicating flow channels 55 are provided between the first filter chambers 561, it is preferable that the number of the communicating flow channels 55 be the number which is smaller by one or more than the number of the first filter chambers 561. Thereby, it is preferable that the number of the second filter chambers 562 corresponding to the communicating flow channels 55 is also smaller than the number of the first filter chambers 561 by one or more. Of course, if four first filter chambers 561 are provided, one or two of the second filter chambers 562 may be provided. However, in order to dispose the most filter chambers 56 in the limited space, it is more preferable that the second filter chambers 562 are provided by the number which is smaller by only one than the number of the first filter chambers 561. In addition, in the embodiment, the first filter chamber 561 is disposed so that the plane direction of the shorter side opened to the first flow channel member 41 side is the first direction X, and the second filter chamber 562 is disposed so that the plane direction of the longer side of the opening is the first direction X. This is also possible because the second filter chambers 562 are provided by the number which is smaller than the number of the first filter chambers 561. Moreover, in this way, since the second filter chambers 562 are disposed so that the plane direction of the longer side of the opening is the first direction X, the size of the flow channel member main body 40 is not increased in the second direction Y and can be decreased in the second direction Y. That is, in a case where the second filter chambers 562 are disposed in the same rotation position as the first filter chambers 561, the plane directions of the longer sides of the openings of both the first filter chambers 561 and the second filter chambers 562 become the second direction Y, and the sizes are increased in the second direction Y. However, in a case where the second filter chambers 562 are provided in the same numbers as the number of the first filter chambers 561, if the first filter chambers 561 and the second filter chambers 562 are disposed in the same rotation direction as each other, increase in the size in the first direction X can be suppressed.

In this way, due to the fact that the first filter chambers 561 which directly communicate with the inlets 54 and the second filter chambers 562 which communicate with the inlets 54 via the communicating flow channels 55 are provided as the filter chambers 56, the size of the flow channel member main body 40 is not increased, the opening area of the filter chambers 56 can be most extended, and the maximum volume can be secured.

The filter chambers 56 which are constituted of the first filter chambers 561 and the second filter chambers 562 are provided so as to penetrate in the thickness direction in the second flow channel member 42, and the opening surfaces of the filter chambers 56 are covered by the first flow channel member 41 and the third flow channel member 43. In addition, the ink from each filter chamber 56 is supplied to the head main body 90 (head case 80) via the supply path 57.

The supply path 57 includes a first supply path 571 which communicates with the filter chamber 56 and is provided so as to penetrate the third flow channel member 43 in the thickness direction, and a second supply path 572 which is provided between the third flow channel member 43 and the base portion 31. In addition, the opening of the first supply path 571 which communicates the filter chamber 56 of the second flow channel member 42 becomes a filter holding portion 573 which is widened, and a filter for supply 59 for removing foreign matter such as dust or bubbles included in the ink is provided in the filter holding portion 573. In addition, the ink from the pressure adjusting chamber 53 is supplied to the filter chamber 56 via the inlet 54, the ink of the filter chamber 56 passes through the filter for supply 59 provided in the filter holding portion 573 and is supplied to the supply port 314 via the first supply path 571 and the second supply path 572, and the ink is supplied from the supply port 314 to the head main body 90.

Moreover, the second supply path 572 is partitioned by a concave portion which is provided on the surface of the base portion 31 side of the third flow channel member 43 and a concave portion which is provided on the surface of the third flow channel member 43 side of the base portion 31. In addition, the supply port 314 which communicates with the supply path 57 and supplies ink to the head main body 90 is provided so as to arrange in one row along the first direction X. Moreover, in the embodiment, as shown in FIG. 1, in the supply port 314, the row which is provided so as to arrange in one row along the first direction X is provided in two rows in the second direction Y. However, two supply ports 314 provided so as to arrange in the second direction Y become one set and is provided in one row along the first direction X. Moreover, the two supply ports 314 of one set arranged in the second direction Y are connected to one head main body 90. Here, for example, in a case where a plurality of head main bodies 90 are held to the back pressure control unit 20 via the head case 80, if the interval or the position of two supply ports 314 which become one set is separately provided for each set, the opening position of the flow channel which is connected to the supply port 314 of the head main body 90 side should be set for each set. Therefore, the flow channel configuration of the inner portion of the head main body 90 is complicated, and increase in the manufacture costs is generated. In the embodiment, since two supply ports 314 which are provided in the same interval and the same position in the second direction Y are provided so as to arrange in one row in the first direction, the head main body 90 having the same shape (the opening positions of the flow channel are the same as one another) with respect to each set can be used, and therefore, the flow channel configuration of the inner portion of the head main body 90 can be simplified. Thus, the manufacture costs of the head main body 90 can be decreased, and it is possible to simplify the assembly process.

In addition, as described above, the following regulations are required. That is, the pressure adjusting chambers 53 are required to be provided as the same volume, the inlet 54 is required to be provided at the same position of each pressure adjusting chamber 53, or the like. Moreover, also in the supply port 314 which is connected to the head main body 90, the position of the supply port which is connected to the head main body 90 is regulated. However, in the embodiment, since the filter chamber 56 is constituted of the first filter chamber 561 which directly communicates with the inlet 54 and the second filter chamber 562 which communicates with the inlet 54 via the communicating flow channel 55, the size of the back pressure control unit 20 is not increased, the filter chamber 56 between the inlet 54 and the supply port 314 in which the positions are regulated is secured can be provided with the size in which the area of the filter for supply 59 becomes the maximum area, and the filter chamber can be disposed in the state where the maximum volume is secured.

In addition, the protection plate 44 which seals the pressure adjusting chambers 53 of the first flow channel member 41 includes a film holding portion 60 which faces each pressure adjusting chamber 53 at the surface of the first flow channel member 41 side, is a space permitting deformation of the film member 45, and has a concave portion.

Moreover, an air opening path 61 which opens the atmosphere of the film holding portion 60 to the air and communicates with the outside is provided in the back pressure control unit 20. The air opening path 61 includes a narrow path 611 which is provided between the protection plate 44 and the cover portion 32 and communicates with the film holding portion 60, a meandering path 612 which communicates with the narrow path 611, and an outside communication hole 613 which communicates with the meandering path 612, penetrates the cover portion 32 and communicates with the outside.

The narrow path 611 is provided with a shape which reciprocates in the second direction Y from the position communicating with the film holding portion 60 to the position communicating with the meandering path 612.

The meandering path 612 is formed of concave grooves which meander in the first direction X while reciprocating in the second direction Y from the position communicating with the narrow path 611 to the position communicating with the outside communication hole 613.

That is, the film holding portion 60 partitioning the space of the side opposite to the pressure adjusting chamber 53 of the film member 45 communicates with the outside through the air opening path 61 which includes the narrow path 611, the meandering path 612, and the outside communication hole 613. In this way, due to the fact that the film holding portion 60 of the side opposite to the pressure adjusting chamber 53 of the film member 45 is opened to the air through the air opening path 61, the film member 45 can be deformed by a differential pressure between the pressure of the inner portion of the pressure adjusting chamber 53 and the air pressure. In addition, since the air opening path 61 is constituted of the narrow path 611, the meandering path 612, and the outside communication hole 613, the course of the air opening path 61 can be formed so as to be long with a narrow cross-section. Thereby, diffusion resistance is applied to the air opening path 61, and evaporation of moisture from the film member 45 can be suppressed. In addition, since the moisture of the ink which is charged in the pressure adjusting chamber 53 permeates the film member 45, if the air opening path to which the diffusion resistance is not applied is provided, the moisture of the ink permeating the film member 45 is easily evaporated, and disadvantages such as increase in viscosity of the ink are generated. In the embodiment, since evaporation of the moisture of the ink permeating the film member 45 can be suppressed, disadvantages such as the increase in the viscosity of the ink can be suppressed.

In addition, as shown FIGS. 4 to 6, the first seal portion 34, a second seal portion 35, and a third seal portion 36 which are formed of rubber, elastomer, or the like are provided in the cover portion 32 in a state of being separated to one another.

As described above, the first seal portion 34 is provided over the tip surface of the second wall portion 322 of the cover portion 32, a joint of the outer circumference of the base portion 31 and the cover portion 32 is sealed by the first seal portion 34, and the ink in the holding portion 33 of the cover 30 is suppressed from flowing the outside.

The second seal portion 35 is provided in the position which faces the meandering path 612 of the cover portion 32, and seals the opening of the cover portion 32 side of the meandering path 612. In addition, as shown in FIG. 6, a communicating hole 35*a* which communicates with the outside communication hole 613 of the air opening path 61 is provided in the second seal portion 35, and actually, the second seal portion 35 seals regions other than the communicating hole 35*a* of the meandering path 612.

The third seal portion 36 is provided over the periphery of the opening portion 323 on the surface of the protection plate 44 side of the protrusion 324 on which the above-described opening portion 323 is provided. The third seal portion 36 seals a gap between the periphery of the connection port 51 of the flow channel member main body 40 and the cover portion 32. Due to the fact that the cover portion 32 is fixed to the opening portion 323 by the third seal portion 36, the ink which is leaked at the time of attaching and detaching of the supply tube connected to the connection port 51, or the like can be suppressed from flowing into the holding portion 33, and the ink in the holding portion 33 can be suppressed from being leaked from the gap between the periphery of the connection portion 51 and the cover portion 32.

The first seal portion 34, the second seal portion 35, and the third seal portion 36 each are provided at positions having different heights in the cover portion 32. Specifically, as described above, the first seal portion 34 is provided on the tip surface of the second wall portion 322 of the cover portion 32. In addition, the second seal portion 35 is provided on the bottom surface (surface which faces the protection plate 44) of the second holding portion 321 of the cover portion 32. Moreover, the third seal portion 36 is provided on the tip surface of the protrusion 324 which protrudes lower than the second wall portion 322 of the cover portion 32. Therefore, the first seal portion 34, the second seal portion 35, and the third seal portion 36 each are provided at positions having different heights of the cover portion 32. Here, the height of the cover portion 32 means the height in the thickness direction at the direction in which the base portion 31 and the cover portion 32 are laminated to each other. Therefore, the first seal portion 34, the second seal portion 35, and the third seal portion 36 are provided at positions which are different in the laminated direction of the cover portion 32.

Moreover, it is difficult to make the height of the second wall portion 322 of the cover portion 32 be the same as the bottom surface of the cover portion 32 in which the second seal portion 35 is provided or the protrusion 324 in which third seal portion 36 is provided. For example, this is because the second holding portion 321 can not sufficiently be secured if the height of the second wall portion 322 is the same as the height of the bottom surface of the cover portion 32 in which the second seal portion 35 is provided. In addition, in order to secure the holding portion 33, even though the height of the first wall portion 315 partitioning the first holding portion 311 of the base portion 31 is higher, a region in which a screw member (not shown) inserted from the bottom surface (head main body side) of the base portion 31 is screwed to the cover portion 32 is not sufficient, and it is difficult to reliably fix the base portion 31 and the cover portion 32 to each other. Moreover, for example, if the height of the second wall portion 322 is the same as the height of the protrusion 324 in which the third seal portion 36 is provided, the third seal portion 36 and the second seal portion 35 are close to each other, and there is a problem in that the ink leaked from the connection port 51 is easily leaked to the outside via the third seal portion 36 and the second seal portion 35. Moreover, if the height of the protrusion 324 is the same as the height of the second wall portion 322, the position of the connection port 51 at the flow channel member main body 40 side should be changed, the area for providing the connection portion 51 of the flow channel member main body 40 is required, and there is a problem in that the size of the main body is increased.

In the embodiment, since the first seal portion 34, the second seal portion 35, and the third seal portion 36 are provided at positions having different heights of the cover portion 32, the base portion 31 and the cover portion 32 can be securely fixed to each other in the state where the second holding portion 321 is sufficiently secured, and leakage of the ink in the holding portion 33 with respect to the outside is not easily generated by separating the first seal portion 34 and the third seal portion 36. In addition, since the first seal portion 34, the second seal portion 35, and the third seal portion 36 can be provided at positions having different heights of the cover portion 32, positions of the boundary of the cover 30 of the back pressure control unit 20, the connection portion 51, and the meandering path 612 can be provided by different heights, and a design freedom is increased and the size can be decreased.

In addition, the first seal portion 34, the second seal portion 35, and the third seal portion 36 are integrally formed by a two-color molding along with the cover portion 32. In the embodiment, after the cover portion 32 is formed by molding a resin material, both are integrally formed by molding a rubber material at a predetermined position of the cover portion 32.

In this way, since the cover portion 32 and, the first seal portion 34, the second seal portion 35, and the third seal portion 36 are integrally formed by a two-color molding, the positioning of the first seal portion 34, the second seal portion 35, and the third seal portion 36 are not required, and assembly operation of the back pressure control unit 20 is simplified, and the costs can be decreased. Particularly, like the embodiment, when the first seal portion 34, the second seal portion 35, and the third seal portion 36 are provided at positions having different heights of the cover portion 32, the positionings are not required, the assembly operation can be simplified, and occurrence to leakage of the ink due to the positional deviation of the first seal portion 34, the second seal portion 35, and the third seal portion 36 can be suppressed.

Moreover, since the cover portion 32 and, the first seal portion 34, the second seal portion 35, and the third seal portion 36 are integrally formed by the two-color molding, compared to the case where plate-like seal members which are separated are used, number of the components can be decreased, and the manufacture costs and the assembly costs can be decreased.

In addition, as shown in FIGS. 4 and 5, valves 100 which open and close the communicating state of the introduction paths 52 and the pressure adjusting chambers 53 are provided between the introduction paths and the pressure adjusting chambers.

Specifically, cylindrical case portions 101 which are vertically extended in the introduction paths 52 (fourth introducing flow channel 521*e* and seventh introducing flow channel 522*d*) are formed on the bottom surface of the third flow channel member 43. The lower surfaces of the case portions 101 abut the bottom surfaces of the fourth introducing flow channel 521*e* and the seventh introducing flow channel 522*d*. In addition, the inner portions of the case portions 101 communicate with the pressure adjusting chambers 53, and silts 102 which communicate with the inner portions and the outer portions of the case portions 101 are provided on the side surfaces of the case portions 101. Thereby, the pressure adjusting chambers 53 and the introduction paths 52 communicate with each other via the inner portions and the outer portions of the case portions 101.

Moreover, the valves 100 are provided in the case portions 101. Each of valves 100 includes a columnar shaft portion 104 which is inserted into an insertion hole 103 communicating the inner portion of the case portion 101 and the pressure adjusting chamber 53 and a disk-shaped flange portion 105 which is provided on the lower end of the shaft portion 104 in the case portion 101 and has a larger outer diameter than the outer diameter of the shaft portion 104. The lower end of the shaft portion 104 is connected to the center on the upper surface of the flange portion 105, and the upper end of the shaft portion 104 abuts the lower surface of the elastic plate 46 (surface of pressure adjusting chamber 53 side).

The outer diameter of the flange portion 105 is larger than the inner diameter of the insertion hole 103, and is slightly smaller than the inner diameter of the case portion 101. Moreover, a coil spring 106 which is an example of a biasing member is interposed between the lower surface (surface of second flow channel member 42 side) of the flange portion 105 and the bottom surface of the fourth introducing flow channel 521*e* and the seventh introducing flow channel 522*d*.

The coil spring 106 biases the valve 100 toward the upper portion (film member 45 side) which is a direction in which the valve always becomes a closed state. In addition, in the closed state of the valve 100, the flange portion 105 comes close contact into the upper wall surface in the case portion 101, and a state where the insertion hole 103 is closed, that is, a non-communication state in which the inner portion of the case portion 101 and the introduction path 52 do not communicate with each other becomes.

In addition, if the inner portion of the pressure adjusting chamber 53 becomes a negative pressure by supplying of ink to the head main body 90, the film member 45 is displaced so as to be bent to the pressure adjusting chamber 53 side (second flow channel 42 side) by the differential pressure between the pressure of the pressure adjusting chamber and the air pressure of the inner portion of the film holding portion 60. According to the displacement of the film member 45, the elastic portion 46*c* of the elastic plate 46 is elastic-displaced so as to be bent toward the second flow channel member 42 side.

By the elastic deformation of the elastic plate 46, the shaft portion 104 presses the valve 100 to the second flow channel member 42 side against the biasing force of the coil spring 106. Therefore, the flange portion 105 is separated from the wall surface which opens the insertion hole 103, and the pressure adjusting chamber 53 and the introducing chamber 52 communicate with each other.

In this way, if the pressure adjusting chamber 53 and the introducing chamber 52 communicate with each other, the ink in the introduction path 52 flows into the pressure adjusting chamber 53. Moreover, if ink is sufficiently charged in the pressure adjusting chamber 53 and the supply path 57, the negative pressure of the pressure adjusting chamber 53 is eliminated. Therefore, the elastic plate 46 is returned to the original state, each valve 100 is closed by the biasing force of each coil spring 106, and the inner portion of each pressure adjusting chamber 53 is always held to a constant pressure.

The head case 80 which holds the circuit board 70 between the base portion 31 and the head case and the head main body 90 which is provided on the lower surface of the head case 80 are provided on the bottom surface of the base portion 31 of the back pressure control unit 20.

The head case 80 has an area which is substantially the same as the area of the base portion 31 and is fixed to the bottom surface of the base portion 31, and the circuit 70 is held between the head case 80 and the base portion 31.

In the circuit board 70, connectors to which external wirings are connected are disposed so as to be upward on the region which faces the wiring insertion hole 312. The circuit board 70 can be used so as to be connected in common with a plurality of head main bodies 90.

Although not shown particularly, in the head main body 90, two or more rows in which the nozzle openings are juxtaposed are provided, and each kind of ink supplied from each back pressure control unit 20 is provided so as to be discharged from each nozzle row. In the embodiment, although not shown particularly, four head main bodies 90 are provided, two colors of inks are discharged from three head main bodies 90, and one color of ink from one head main body 90 is discharged from the nozzle row having two rows. Thereby, seven colors of ink can be discharged. In addition, the number or the position of the head main bodies 90 is not particularly limited to this, and for example, the head main bodies 90 having the same number as the number of the supply paths 57 may be provided.

In addition, although not shown particularly, a pressure generation chamber which communicate the nozzle opening and a pressure generation means which generates pressure change in the pressure generation chamber are provided in the head main body 90. As the pressure generation means, for example, one which changes the volume of the pressure generation chamber by deformation of a piezoelectric actuator having piezoelectric materials which exhibit an electromechanical conversion function, generates a pressure change, and discharge the ink droplets from the nozzle openings; one which disposes a heater element in the pressure generation chamber and discharge the ink droplets from the nozzle openings by bubbles which are generated by the heat of the heat element; a so-called electrostatic actuator which generates static electricity between a vibrating plate and an electrode, deforms the vibrating plate by the electrostatic force, and discharge the ink droplets from the nozzle openings; or the like may be used.

As described above, in the embodiment, the filter chambers 56 are provided in the middle of the flow channels which supplies ink from the pressure adjusting chambers 53 to the head main body 90, and the first filter chambers 561 which directly communicate with the pressure adjusting chambers 53 via the inlets 54 and the second filter chambers 562 which communicate with the pressure adjusting chambers 53 via the inlets 54 and the communicating flow channels 55 are provided as the filter chambers 56. Therefore, the first chambers 561 and the second filter chambers 562 can be juxtaposed in the second direction Y. Thereby, increase in the size of the flow channel member main body 40 is suppressed, and the filter chambers 56 can be provided at maximum volume and the filter for supply 59 can be provided at maximum area in the state where the size of the back pressure control unit 20 is decreased. In this way, since the filter chambers 56 are provided at maximum volume, amount of the bubbles held in the filter chambers 56 can be increased, the frequency of the cleaning operation is decreased, and wasteful ink consumption can be suppressed. In addition, since the filter for supply 59 is provided at maximum area, the flow channel resistance of the filter for supply 59 is decreased, and occurrence in failure of the ink supply can be suppressed.

Moreover, in the embodiment, the first flow channel member 41, the second flow channel member 42, the third flow channel member 43, and the protection plate 44 are provided as the flow channel member main body 40. However, for example, if the inlets 54 are not provided so as to be directly opened to the first filter chambers 561 and the inlets 54 and the first filter chambers 561 communicate with each other via the communicating flow channels 55 or the like, another flow channel member should be added between the first flow channel member 41 and the second flow channel member 42, and therefore, the number of components is increased and the costs are increased. Particularly, when each flow channel member is formed by an inexpensive molding, the flow channel member is required to be added from the manufacture reasons. In the embodiment, since the first filter chamber 561 directly communicates with the inlets 54, the flow channel member main body 40 can be constituted of the first flow channel member 41, the second flow channel member 42, the third flow channel member 43, and the protection plate 44, and therefore, the number of the components is decreased and the costs can be decreased.

Other Embodiments

An embodiment of the invention is described as above. However, the basic configuration of the invention is not limited to the above-described those. For example, in the above-described first embodiment, four first filter chambers 561 are provided, and three second filter chambers 562 are provided. However, the number of the first filter chambers 561 and the second filter chambers 562 is not limited to this.

Figure 7:
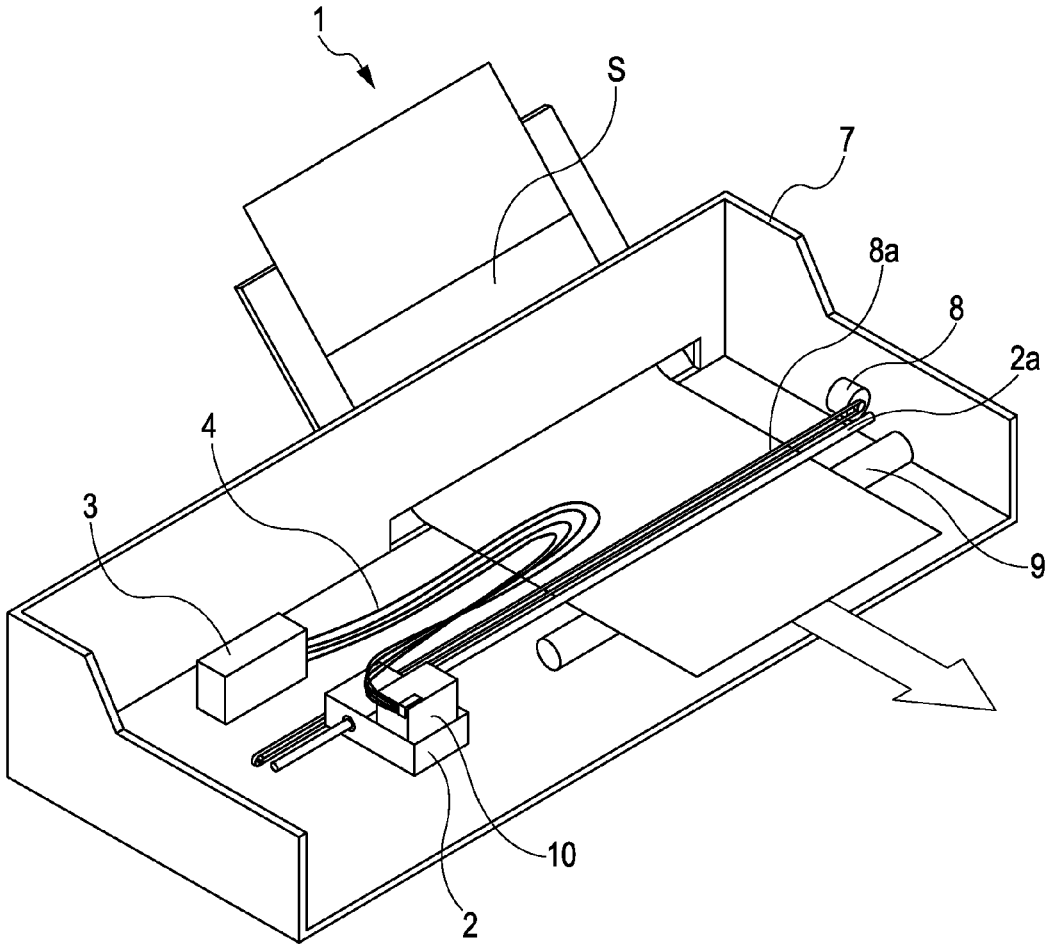
FIG. 7 is a schematic perspective view showing a recording apparatus according to the first embodiment of the invention.

In addition, the above-described ink jet type recording head 10 is mounted on an ink jet type recording apparatus. FIG. 7 is a schematic perspective view showing an example of the ink jet type recording apparatus. As shown in FIG. 7, in the ink jet type recording apparatus 1 of the embodiment, the ink jet type recording head 10 is mounted on a carriage 2. In addition, the carriage 2 on which the ink jet type recording head 10 is mounted is provided so as to axially move on a carriage shaft 2*a* which is mounted on an apparatus main body 7.

Moreover, a storage means 3 which is constituted of a tank storing ink is provided in the apparatus main body 7, and the ink from the storage means 3 is supplied to the ink jet type recording head 10 (back pressure control unit 20) mounted on the carriage 2 via a supply tube 4.

Moreover, since driving force of a drive motor 8 is transferred to the carriage 2 via a plurality of gears (not shown) and a timing belt 8*a*, the carriage 2 on which the ink jet type recording head 10 is mounted moves along the carriage shaft 2*a*. On the other hand, a platen 9 is provided along the carriage shaft 2*a* in the apparatus main body 7, a recording sheet S, which is a recording medium such as a paper which is fed by feeding rollers (not shown) or the like, is wound around the platen 9 and transported.

In the ink jet type recording apparatus 1, the carriage 2 moves along the carriage shaft 2*a*, and the ink is discharged by the head main body 90 of the ink jet type recording head 10 and is printed on the recording sheet S.

Moreover, in the above-described ink jet type recording apparatus 1, the case where the ink jet type recording head 10 is mounted on the carriage 2 and moves in a main scanning direction is exemplified. However, the invention is not limited to this, for example, the invention may be also applied to a so-called line type recording apparatus in which the ink jet type recording head 10 is fixed to the apparatus main body 7 and the printing is performed only by moving the recording sheet S such as papers in a sub scanning direction.

Moreover, in the above-described example, the ink jet type recording head 10 is described as an example of the liquid ejecting head and the ink jet type recording apparatus 1 is described as an example of the liquid ejecting apparatus. However, the invention includes all liquid ejecting heads and liquid ejecting apparatuses, and therefore, the invention may be applied to liquid ejecting heads or liquid ejecting apparatuses which eject liquids other than ink. As other liquid ejecting heads, for example, there are various recording heads which are used in an image recording apparatus such as a printer, a color material ejecting head which is used for manufacturing a color filter such as a liquid crystal display, an electrode material ejecting head which is used for forming electrodes of an organic EL display, a FED (Field Emission Display), or the like, a bioorganic material ejecting head which is used for manufacturing a bio chip, and the like. In addition, the invention may be also applied to the liquid ejecting apparatus including the liquid ejecting head.

The entire disclosure of Japanese Patent Application No. 2011-066809, filed Mar. 24, 2011 is expressly incorporated by reference herein.

What is claimed is:

1. A liquid ejecting head comprising:

a head main body which ejects liquid; and a flow channel member to which the head main body is fixed, wherein the flow channel member includes a plurality of liquid chambers to which the liquid is supplied, the flow channel member includes a filter chamber, the filter chamber includes a plurality of first filter chambers which are aligned in a first row and a plurality of second filter chambers which are aligned in a second row parallel to the first row, and each of the plurality of first and second filter chambers has a filter, a plurality of inlets are provided to pass the liquid between the plurality of liquid chambers and the plurality of first and second filter chambers, respective, and the plurality of inlets are aligned in a third row parallel to the first and second rows, a plurality of communicating flow channels are provided between the plurality of first filter chambers so that each of the plurality of communicating flow channels is located between the adjacent two of the plurality of first filter chambers, and each of the plurality of communicating flow channels is provided to pass the liquid between one of the plurality of liquid chambers and one of the plurality of second filter chambers via one of the plurality of inlets, and a number of the plurality of liquid chambers, a number of the plurality of inlets, and a number of the plurality of first and second filter chambers are the same, and a number of the plurality of communicating flow channels and a number of the plurality of second filter chambers are the same.

2. The liquid ejecting head according to claim 1, wherein volume of each of the plurality of first filter chambers is the same as volume of each of the plurality of second filter chambers.

3. The liquid ejecting head according to claim 1, wherein the flow channel member is configured with first through third channel members that are stacked to one another in this order, the first channel member includes the plurality of liquid chambers and the plurality of inlets, the second channel member includes the plurality of first and second filter chambers and the plurality of communicating flow channels, and the third channel member includes the filters.

4. The liquid ejecting head according to claim 1, wherein the number of the plurality of second filter chambers is smaller by one or more than the number of the plurality of first filter chambers.

5. A liquid ejecting apparatus comprising the liquid ejecting head according to claim 1.

6. A liquid ejecting apparatus comprising the liquid ejecting head according to claim 2.

7. A liquid ejecting apparatus comprising the liquid ejecting head according to claim 3.

8. A liquid ejecting apparatus comprising the liquid ejecting head according to claim 4.

9. A liquid ejecting head comprising:

a head main body that ejects liquid;

a first flow channel member that is fixed to the head main body, the first flow channel member including:

a plurality of liquid chambers; and a plurality of inlets that provide liquid flow communication with the plurality of liquid chambers, each of the plurality of inlets being respectively overlapped with each of the plurality of liquid chambers, the plurality of inlets being aligned in a first row;

a second flow channel member that is fixed to the first flow channel member, the second flow channel member including:

a plurality of first filter chambers that are aligned in a second row parallel to the first row;

a plurality of second filter chambers that are aligned in a third row parallel to the first and second rows, each of the plurality of first and second filter chambers has a filter;

a plurality of communicating flow channels that are provided between the plurality of first filter chambers so that each of the plurality of communicating flow channels is located between the adjacent two of the plurality of first filter chambers;

each of the plurality of first and second filter chambers providing the liquid flow communication with each of the plurality of liquid chambers via each of the plurality of inlets; and each of the plurality of communicating flow channels providing the liquid flow communication between one of the plurality of liquid chambers and one of the plurality of second filter chambers via one of the plurality of inlets; and a third flow channel member that is fixed to the second flow channel member, the third flow channel member including the filters, wherein a number of the plurality of liquid chambers, a number of the plurality of inlets, and a number of the plurality of first and second filter chambers are the same, and a number of the plurality of communicating flow channels and a number of the plurality of second filter chambers are the same.

10. The liquid ejecting head according to claim 9, wherein volume of each of the plurality of first filter chambers is the same as volume of each of the plurality of second filter chambers.

11. The liquid ejecting head according to claim 9, wherein the plurality of liquid chambers are aligned in a fourth row parallel to the first through third rows, and the first row, the second row, and the fourth row are vertically overlapped to one another.

12. A liquid ejecting apparatus comprising the liquid ejecting head according to claim 9.

13. A liquid ejecting apparatus comprising the liquid ejecting head according to claim 10.

14. A liquid ejecting apparatus comprising the liquid ejecting head according to claim 11.

* * * * *